US008834114B2

(12) United States Patent
Sterantino et al.

(10) Patent No.: US 8,834,114 B2
(45) Date of Patent: Sep. 16, 2014

(54) TURBINE DRUM ROTOR RETROFIT

(75) Inventors: Carol Ann Sterantino, Guilderland, NY (US); Sarah Elizabeth DiDomizio, Ballston Spa, NY (US); Sesha Kiran Gundavarapu, Bangalore (IN); Jason Winfred Jewett, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 438 days.

(21) Appl. No.: 13/248,793

(22) Filed: Sep. 29, 2011

(65) Prior Publication Data

US 2013/0084171 A1 Apr. 4, 2013

(51) Int. Cl.

| | |
|---|---|
| ***F01D 5/06*** | (2006.01) |
| ***F01D 5/00*** | (2006.01) |
| ***F01D 25/24*** | (2006.01) |
| ***F01K 7/16*** | (2006.01) |

(52) U.S. Cl.

CPC . *F01K 7/16* (2013.01); *F01D 5/005* (2013.01); *F01D 25/246* (2013.01)

USPC ..... 415/209.2

(58) Field of Classification Search

USPC ..... 415/209.2, 209.3, 209.4, 214.1, 912; 29/889.22

See application file for complete search history.

(56) References Cited

U.S. PATENT DOCUMENTS

| | | | | |
|---|---|---|---|---|
| 5,259,727 | A | 11/1993 | Quinn | |
| 5,308,227 | A | 5/1994 | Gros et al. | |
| 5,350,276 | A * | 9/1994 | Gros | 415/168.4 |
| 5,411,365 | A * | 5/1995 | Mazzola et al. | 415/93 |
| 5,627,761 | A * | 5/1997 | Pollard | 700/279 |
| 6,305,901 | B1 | 10/2001 | Bell et al. | |
| 6,733,237 | B2 * | 5/2004 | Ingistov | 415/209.2 |
| 6,752,589 | B2 | 6/2004 | Vogan et al. | |
| 7,726,022 | B2 | 6/2010 | Trbojevic et al. | |
| 7,955,048 | B2 * | 6/2011 | Lord et al. | 415/144 |
| 2008/0193283 | A1 * | 8/2008 | Burdgick et al. | 415/190 |
| 2010/0028146 | A1 * | 2/2010 | Martin et al. | 415/209.3 |
| 2013/0195641 | A1 * | 8/2013 | Povey | 415/208.2 |

* cited by examiner

*Primary Examiner* — Ned Landrum
*Assistant Examiner* — Liam McDowell
(74) *Attorney, Agent, or Firm* — Dale J. Davis; Hoffman Warnick LLC

(57) ABSTRACT

Systems for increasing the efficiency of a turbine and an overall power plant system are disclosed. In one embodiment, a turbine includes: an outer shell including a set of grooves configured to complement components of a wheel and diaphragm steam path section; a drum rotor disposed within the outer shell; a set of shell converts connected to the outer shell via the set of grooves, the set of shell converts configured to complement components of the drum rotor; and a working fluid passage substantially defined by the drum rotor and the set of shell converts.

18 Claims, 5 Drawing Sheets

TURBINE DRUM ROTOR RETROFIT

BACKGROUND OF THE INVENTION

The subject matter disclosed herein relates to turbines and, more particularly, to a drum rotor retrofit of a steam turbine.

Some power plant systems, for example certain simple-cycle and combined-cycle power plant systems, employ turbines (e.g., steam turbines) in their design and operation. These steam turbines define a steam path which is used to channel and generate power from steam being conveyed through the power plant system. Some of these steam turbines include a wheel and diaphragm section as a portion of the steam path. The wheel and diaphragm section includes a rotor, and sets of buckets, wheels, blades, and nozzles which are configured to define a number of stages within an outer shell of the steam turbine. These stages contribute to the efficiency and reaction of the steam turbine. However, the wheel and diaphragm sections of some steam turbines may have mechanical limitations, non-optimized rotors and steam paths, small rotor diameters, poor stiffness, and/or a high dynamic response. These limitations and inefficiencies may cause rubbing within the turbine and decreased efficiency of the power plant system. Some power plant systems completely replace these wheel and diaphragm sections with drum rotor sections which may have increased stiffness and efficiency. However, complete replacement may necessitate a significant amount of down time, retooling and materials; requiring that all components, including the outer shell of the previous wheel and diaphragm section be replaced.

BRIEF DESCRIPTION OF THE INVENTION

Systems for increasing the efficiency, reliability and durability of a turbine and an overall power plant system are disclosed. In one embodiment, a turbine includes: an outer shell including a set of grooves configured to complement components of a wheel and diaphragm steam path section; a drum rotor disposed within the outer shell; a set of shell converts connected to the outer shell via the set of grooves, the set of shell converts configured to complement components of the drum rotor; and a working fluid passage substantially defined by the drum rotor and the set of shell converts.

A first aspect of the invention provides a turbine including: an outer shell including a set of grooves configured to complement components of a wheel and diaphragm steam path section; a drum rotor disposed within the outer shell; a set of shell converts connected to the outer shell via the set of grooves, the set of shell converts configured to complement components of the drum rotor; and a working fluid passage substantially defined by the drum rotor and the set of shell converts.

A second aspect of the invention provides a method including: separating portions of an outer shell of a steam turbine, wherein the outer shell of the steam turbine includes a set of nozzles configured to complement components of a wheel and diaphragm steam path section; removing wheel and diaphragm components from the portions of the outer shell of the steam turbine; installing a set of shell converts in the portions of the outer shell of the steam turbine via the set of nozzles, the set of shell converts configured to complement components of a drum rotor; installing a drum rotor in the portions of the outer shell; and reassembling the outer shell.

A third aspect of the invention provides a power generation system including: a generator; a turbine operatively connected to the generator, the turbine including: an outer shell including a set of grooves configured to complement components of a wheel and diaphragm steam path section; a drum rotor disposed within the outer shell; a set of shell converts connected to the outer shell via the set of grooves, the set of shell converts configured to complement components of the drum rotor; and a working fluid passage substantially defined by the drum rotor and the set of shell converts.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
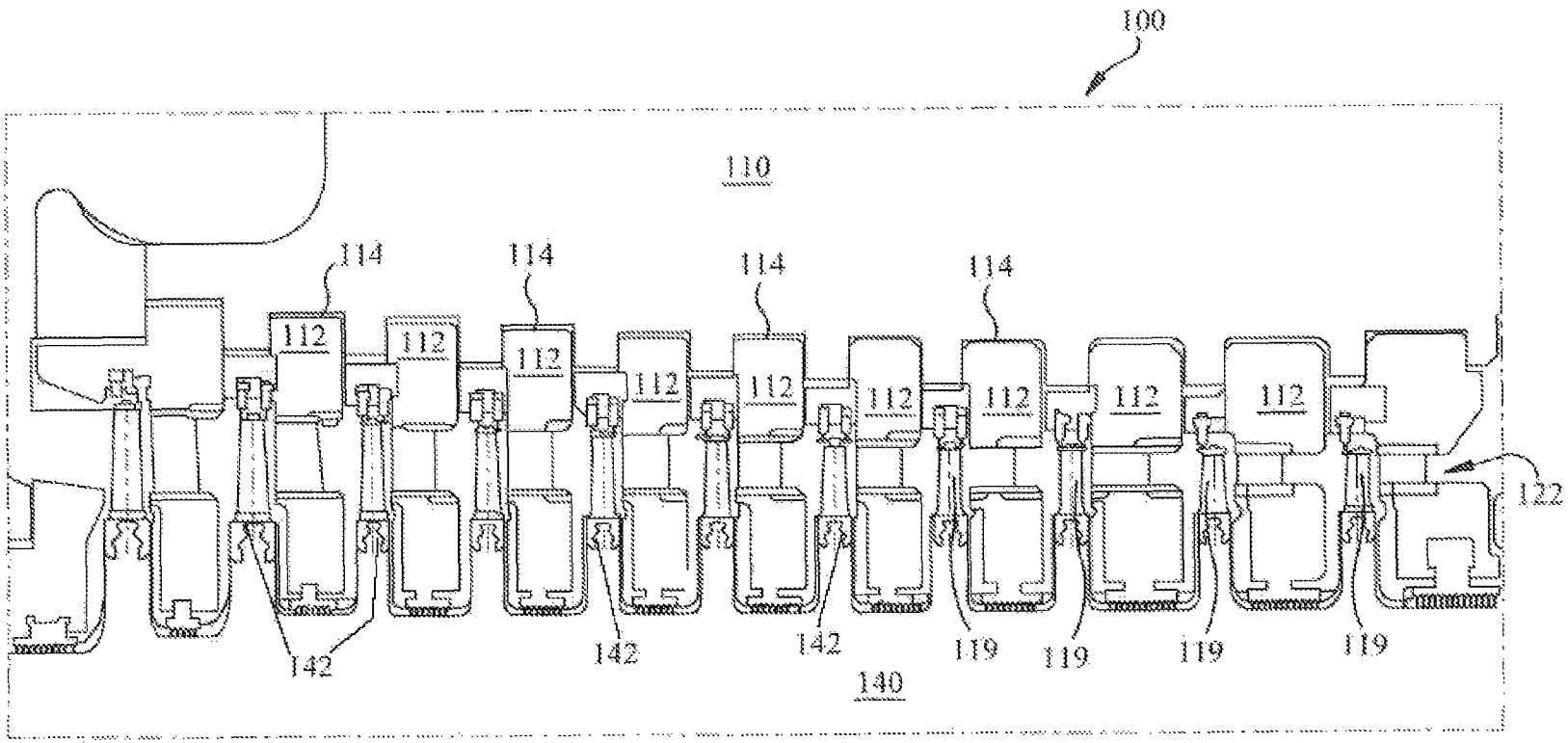
FIG. 1 (Prior Art)
FIG. 1 shows a schematic cut-away view of portions of a wheel and diaphragm section of a steam turbine.

It is noted that the drawings of the disclosure may not necessarily be to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated herein, aspects of the invention provide for systems configured to increase the stiffness, efficiency, and durability of a steam turbine by retrofitting an outer shell of the steam turbine to complement a drum rotor steam path section. These systems employ shell converts, which are configured to connect to portions of a shell for an existing wheel and diaphragm steam path section, these shell converts connecting to the existing shell grooving and complementing a drum rotor steam path section.

In the art of power generation systems (including, e.g., nuclear reactors, steam turbines, gas turbines, etc.), turbines are often employed as part of the system and may include a wheel and diaphragm section as part of the rotor and steam path. Typically, wheel and diaphragm sections partially define a portion of the steam path and convert thermal energy into power. These sections include a wheel and diaphragm rotor which consists of a slender rotor body with multiple wheels and attached rotating blades. The wheel and diaphragm sections typically have smaller rotor diameters as compared to a drum rotor, this may result in reduced stiffness, require larger radial clearances, limit the number of stages in the turbine, and lead to rubbing of components within the turbine. In contrast, a drum rotor has a larger diameter body with the rotating blades attached directly to the rotor body via internal slots.

Embodiments of the current invention provide for a retrofitted steam turbine including a drum rotor steam path section which is installed within the outer shell of a wheel and diaphragm steam path section, thereby replacing the wheel and diaphragm steam path section. Shell converts are configured to connect to the existing grooves within the outer shell of the wheel and diaphragm steam path section and complement a drum rotor. In this manner, removed components and/or portions of the wheel and diaphragm steam path section may be replaced by components and/or portions of the drum rotor steam path section.

Turning to the FIGURES, embodiments of a steam turbine retrofit are shown, where the steam turbine retrofit may increase the thermal efficiency, reliability and longevity of a turbine, the rotor and the overall power generation system by retrofitting a drum rotor steam path section into an existing wheel and diaphragm shell. Each of the components in the FIGURES may be connected via conventional means, e.g., via a common conduit or other known means as is indicated in FIGS. 1-5. Specifically, referring to FIG. 1, a schematic partial cut-away side view of portions of a turbine 100 is shown. Portions of turbine 100 illustrated in FIG. 1 are known wheel and diaphragm steam path sections and may include an outer shell 110, and a plurality of nozzles 112 disposed within outer shell 110 via a plurality of nozzle grooves 114, thereby partially defining a working fluid passage 122 (e.g., steam path). Outer shell 110 is configured to complement wheel and diaphragm steam path section components (e.g., plurality of nozzles 112) and substantially enclose a wheel and diaphragm rotor 140 which includes a plurality turbine buckets 142, further defining working fluid passage 122. During operation, steam is introduced to turbine 100 via working fluid passage 122 and conveyed between wheel and diaphragm rotor 140 and outer shell 110 through stationary nozzles 112 and a plurality of rotating blades 119 connected to turbine buckets 142.

Figure 2:
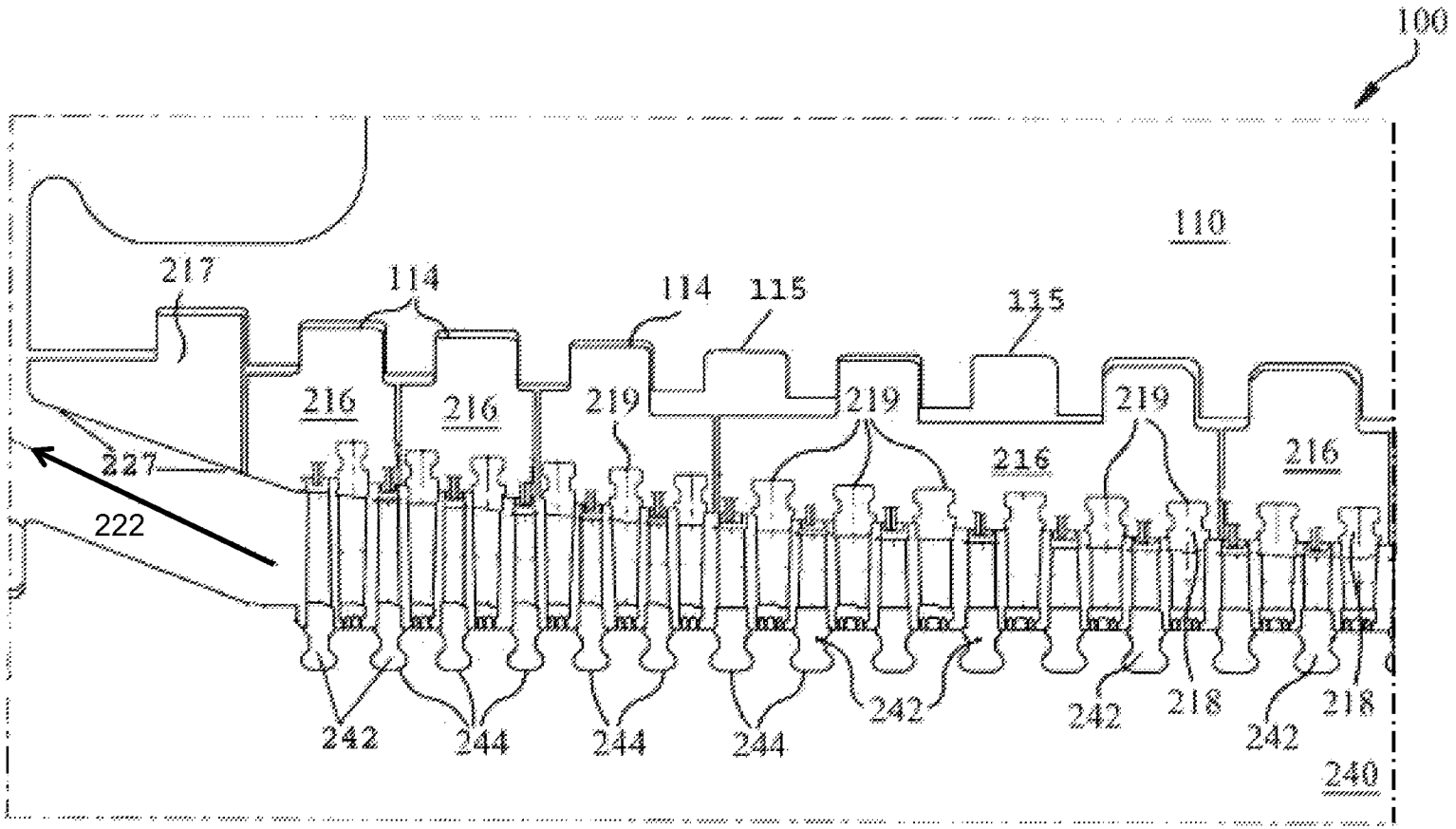
FIG. 2 shows a schematic cut-away view of portions of a steam turbine in accordance with an aspect of the invention.

Turning to FIG. 2, a schematic cut-away side view of portions of turbine 100 is shown according to embodiments of the invention. It is understood that elements similarly numbered between FIG. 1 and FIG. 2 may be substantially similar as described with reference to FIG. 1. Further, in embodiments shown and described with reference to FIGS. 2-5, like numbering may represent like elements. Redundant explanation of these elements has been omitted for clarity. Finally, it is understood that the components of FIGS. 1-5 and their accompanying descriptions may be applied to any embodiment described herein.

Returning to FIG. 2, in this embodiment, turbine 100 may include a drum rotor 240 which is substantially enclosed by outer shell 110. In this embodiment, drum rotor 240 has replaced wheel and diaphragm rotor 140 of FIG. 1. In one embodiment, drum rotor 240 may define a plurality of bucket dovetail slots 244. In one embodiment, drum rotor 240 may be connected to a plurality of turbine buckets 242 via plurality of bucket dovetail slots 244.

In an embodiment of the invention, a set of shell converts 216 may be connected to outer shell 110. In one embodiment, set of shell converts 216 may be configured to connect to existing nozzle grooves 114 in outer shell 110 and complement drum rotor 240 and turbine buckets 242. In one embodiment, each shell convert 216 in set of shell converts 216 may connect to multiple nozzle grooves 114.

In another embodiment, each shell convert 216 in set of shell converts 216 may connect to a single nozzle groove 114. In one embodiment, each shell convert 216 in set of shell converts 216 may define a set of nozzle dovetails 219. In one embodiment, each shell convert 216 defines a single nozzle dovetail 219. In another embodiment, each shell convert 216 defines multiple nozzle dovetails 219. It is understood that a mixture of shell converts 216 (e.g., shell converts 216 defining a single nozzle dovetail 219 and shell converts 216 defining multiple nozzle dovetails 219) may be installed in turbine 100. In one embodiment, a plurality of nozzles 218 may be disposed in set of shell converts 216 via nozzle dovetails 219. The plurality of nozzles 218 in each shell convert 216 configured to complement drum rotor 240 and plurality of turbine buckets 242, thereby increasing the number of stages in a working fluid passage 222 of turbine 100. In one embodiment, set of shell converts 216 may accommodate an increase in drum rotor 240 dimensions. In one embodiment, at least one shell convert 217 may define a flow guide surface 227 to form and adjust the fluid flow in portions of working fluid passage 222. Flow guide surface 227 adjusting a flow, pressure, direction, speed, transition, etc. of a fluid in working fluid passage 222. It is understood that flow guide surface 227 may be angled, oriented, textured or patterned in any manner known in the art. In one embodiment, a set of nozzle grooves 115 in outer shell 110 are covered by shell converts 216 but are not connected to shell converts 216.

Figure 3:
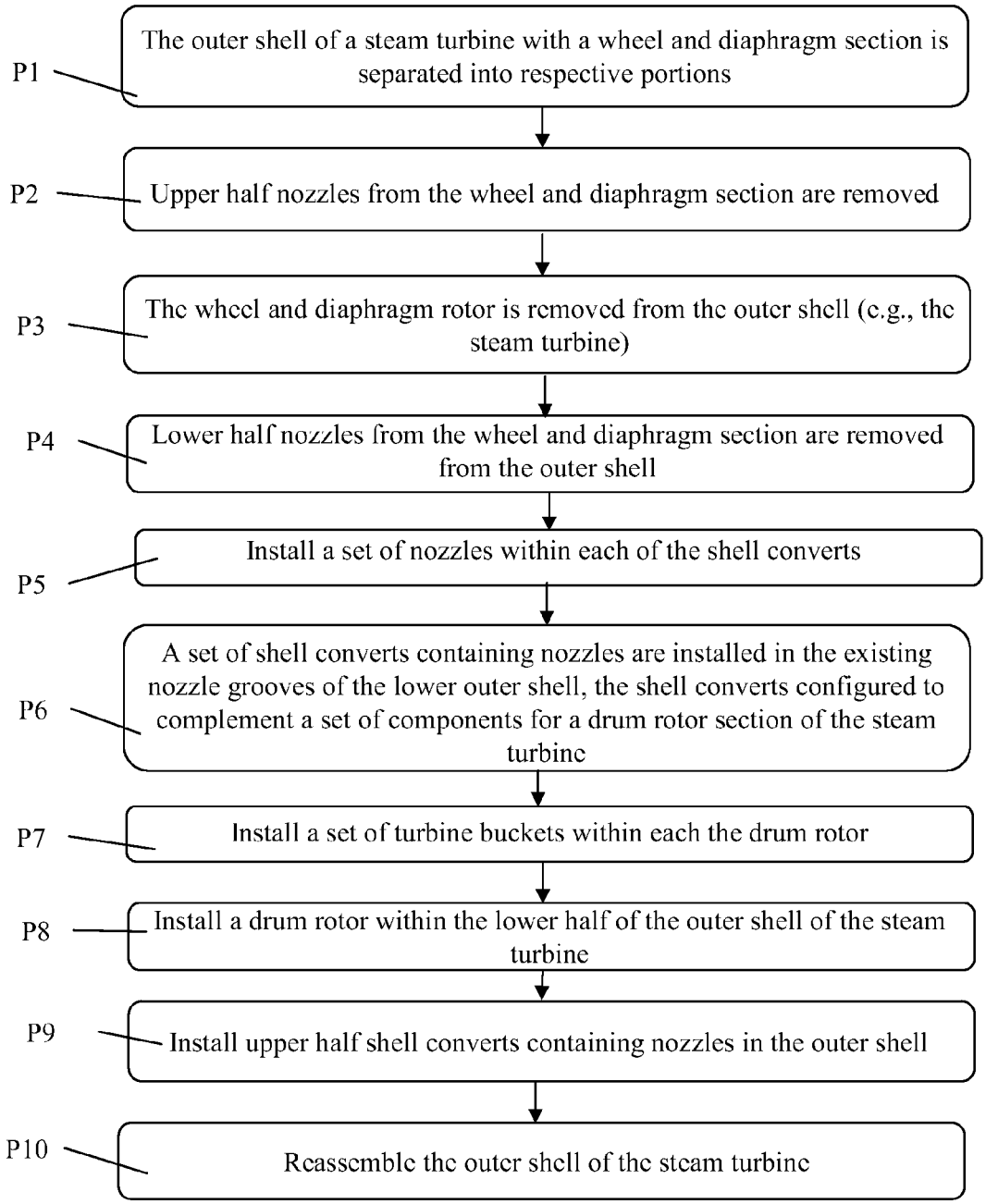
FIG. 3 shows a method flow diagram illustrating a process according to embodiments of the invention.

Turning to FIG. 3, an illustrative method flow diagram is shown according to embodiments of the invention: In process P1, outer shell 110 of turbine 100 is separated/disassembled into respective portions (e.g. the upper and lower halves of outer shell 110 are separated). This may be done by technicians and/or machinery in response to a scheduled or a user prompted retrofitting process. Following process P1, in process P2, upper half wheel and diaphragm nozzles are removed from outer shell 110. Specifically, nozzles 112 are removed. Following process P2, in process P3, wheel and diaphragm rotor 140 is removed from outer shell 110. Following process P3, in process P4, lower half nozzles 112 are removed from outer shell 110. Following process P4, in process P5, set of nozzles 218 are installed within each shell convert 216. Following process P5, in process P6 a set of shell converts 216 containing nozzles 218 are installed in the lower outer shell 110. In one embodiment, set of shell converts 216 are connected to existing nozzle grooves 114 of outer shell 110. Shell converts 216 configured to complement the grooves and/or nozzle grooves 114 of the previous wheel and diaphragm section. Following P6, at process P7, a set of turbine buckets 242 are installed within drum rotor 240. In one embodiment, set of turbine buckets 242 are aligned with set of nozzles 218. Following P7, at process P8, drum rotor 240 is installed in the lower half of outer shell 110. Following process P8, at process P9 upper half shell converts containing nozzles are installed in outer shell 110 via existing nozzle grooves 114. Following P9, at process P10, outer shell 110 of steam turbine 100 is reassembled about drum rotor 240.

The data flow diagram and block diagrams in the FIGURES illustrate the architecture, functionality, and operation of possible implementations of systems and methods according to various embodiments of the present invention. In this regard, each block in the flowchart or block diagrams may represent a step, segment, or process, which accomplishes a portion of the retrofit of a steam turbine. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose machinery (e.g., automated systems) that perform the specified functions or acts, or combinations of special purpose hardware and computer instructions.

Figure 4:
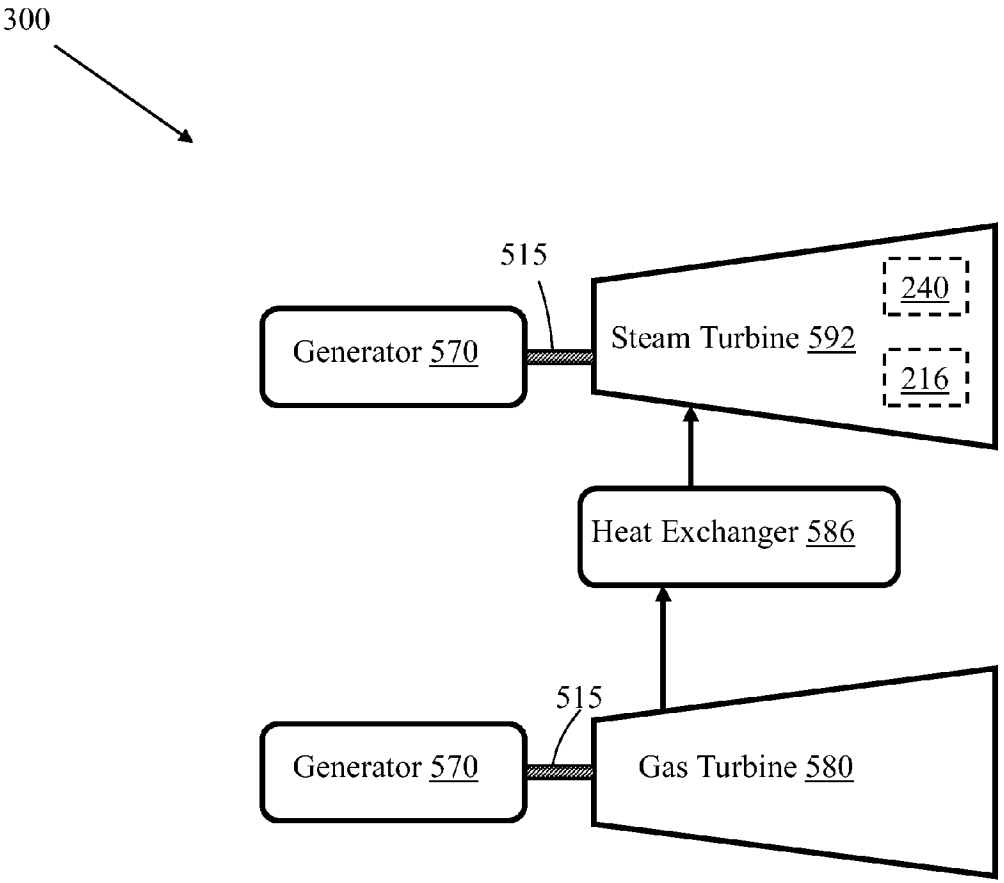
FIG. 4 shows a schematic view of portions of a multi-shaft combined cycle power plant in accordance with an aspect of the invention.
Figure 5:
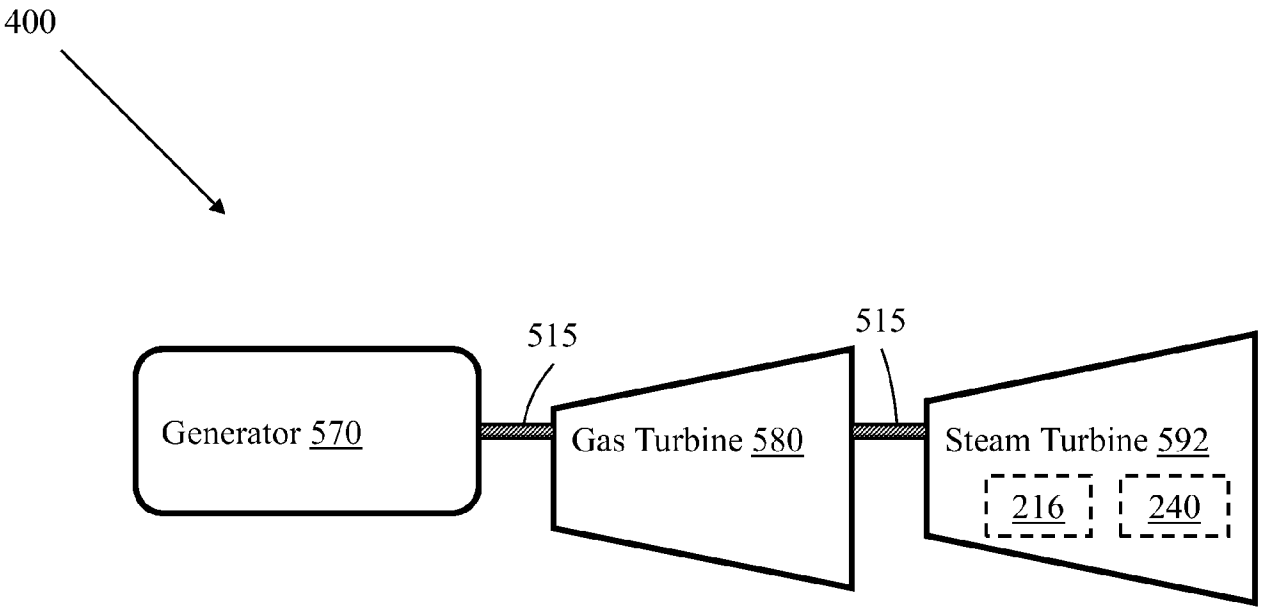
FIG. 5 shows a schematic view of portions of a single-shaft combined cycle power plant in accordance with an aspect of the invention.

Turning to FIG. 4, a schematic view of portions of a multi-shaft combined-cycle power plant 300 is shown. Combined-cycle power plant 300 may include, for example, a gas turbine 580 operably connected to a generator 570. Generator 570 and gas turbine 580 may be mechanically coupled by a shaft 515, which may transfer energy between a drive shaft (not shown) of gas turbine 580 and generator 570. Also shown in FIG. 4 is a heat exchanger 586 operably connected to gas turbine 580 and a steam turbine 592. Heat exchanger 586 may be fluidly connected to both gas turbine 580 and steam turbine 592 via conventional conduits (numbering omitted). Heat exchanger 586 may be a conventional heat recovery steam generator (HRSG), such as those used in conventional combined-cycle power systems. As is known in the art of power generation, HRSG 586 may use hot exhaust from gas turbine 580, combined with a water supply, to create steam which is fed to steam turbine 592. Steam turbine 592 may optionally be coupled to a second generator system 570 (via a second shaft 515). It is understood that generators 570 and shafts 515 may be of any size or type known in the art and may differ depending upon their application or the system to which they are connected. Common numbering of the generators and shafts is for clarity and does not necessarily suggest these generators or shafts are identical. Generator system 570 and second shaft 515 may operate substantially similarly to generator system 570 and shaft 515 described above. Steam turbine 592 may be retrofitted with drum rotor 240 and set of shell converts 216 of FIG. 2 or other embodiments described herein. In one embodiment of the present invention (shown in phantom), steam turbine 592 may be retrofitted with drum rotor 240 and set of shell converts 216 of FIG. 2 or other embodiments described herein. In another embodiment, shown in FIG. 5, a single-shaft combined-cycle power plant 400 may include a single generator 570 coupled to both gas turbine 580 and steam turbine 592 via a single shaft 515. Steam turbine 592 may be retrofitted with drum rotor 240 and set of shell converts 216 of FIG. 2 or other embodiments described herein.

The apparatus and method of the present disclosure is not limited to any one particular steam turbine, turbine, power generation system or other system, and may be used with other power generation systems and/or systems (e.g., combined cycle, simple cycle, nuclear reactor, etc.). Additionally, the apparatus of the present invention may be used with other systems not described herein that may benefit from the increased operational range, efficiency, durability and reliability of the apparatus described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine comprising:

an outer shell including a set of grooves configured to complement components of a wheel and diaphragm steam path section;

a drum rotor disposed within the outer shell, and further including a first plurality of blades connected directly to the drum rotor;

a set of shell converts connected to the outer shell via the set of grooves, the set of shell converts configured to complement components of the drum rotor; and a working fluid passage substantially defined by the drum rotor and the set of shell converts, wherein the components of the wheel and diaphragm path section include:

a rotor body having a diameter, wherein a diameter of the drum rotor is greater than the diameter of the rotor body;

a wheel positioned circumferentially about the rotor body; and a second plurality of blades attached to the wheel.

2. The turbine of claim 1, wherein each shell convert in the set of shell converts defines a set of nozzle dovetails.

3. The turbine of claim 2 further comprising a set of nozzles connected to the set of shell converts via the set of nozzle dovetails.

4. The turbine of claim 1, wherein the drum rotor includes a plurality of bucket dovetails.

5. The turbine of claim 4 wherein the first plurality of blades are a plurality of turbine buckets connected to the drum rotor via the plurality of bucket dovetails, the plurality of turbine buckets configured to complement the set of shell converts.

6. The turbine of claim 1, wherein the set of shell converts increase a number of stages in the turbine.

7. The turbine of claim 1, wherein at least one shell convert in the set of shell converts defines a flow guide surface.

8. A method for retrofitting an outer shell of a steam turbine, the method comprising:

separating portions of the outer shell of the steam turbine, wherein the outer shell of the steam turbine includes a set of grooves configured to complement components of a wheel and diaphragm steam path section;

removing wheel and diaphragm components from the portions of the outer shell of the steam turbine, wherein the components of the wheel and diaphragm include:

a rotor body having a diameter, wherein a diameter of the drum rotor is greater than the diameter of the rotor body;

a wheel positioned circumferentially about the rotor body; and a second plurality of blades attached to the wheel;

installing a set of shell converts in the portions of the outer shell of the steam turbine via the set of grooves, the set of shell converts configured to complement components of a drum rotor;

installing a drum rotor in the portions of the outer shell, including a first plurality of blades connected directly to the drum rotor; and reassembling the outer shell.

9. The method of claim 8 further comprising installing a set of nozzles within each of the shell converts.

10. The method of claim 8 further comprising the first plurality of blades as a set of turbine buckets within the drum rotor.

11. The method of claim 10 further comprising aligning the set of turbine buckets and a set of nozzles installed within each of the shell converts.

12. The method of claim 8 further comprising removing a wheel and diaphragm rotor from the portions of the outer shell.

13. A power generation system comprising:

a generator;

a turbine operatively connected to the generator, the turbine including:

an outer shell including a set of grooves configured to complement components of a wheel and diaphragm steam path section;

a drum rotor disposed within the outer shell, and further including a first plurality of blades connected directly to the drum rotor;

a set of shell converts connected to the outer shell via the set of grooves, the set of shell converts configured to complement components of the drum rotor; and a working fluid passage substantially defined by the drum rotor and the set of shell converts, wherein the components of the wheel and diaphragm path section include:

a rotor body having a diameter, wherein a diameter of the drum rotor is greater than the diameter of the rotor body;

a wheel positioned circumferentially about the rotor body; and a second plurality of blades attached to the wheel.

14. The power generation system of claim 13, wherein each shell convert in the set of shell converts defines a set of nozzle slots.

15. The power generation system of claim 14 further comprising a set of nozzles connected to the set of shell converts via the set of nozzle slots.

16. The power generation system of claim 13, wherein the drum rotor includes a plurality of bucket dovetails.

17. The power generation system of claim 16 wherein the first plurality of blades are a plurality of turbine buckets connected to the drum rotor via the plurality of bucket dovetails, the plurality of turbine buckets configured to complement the set of shell converts.

18. The power generation system of claim 13, wherein each shell convert connects to a single groove in the outer shell.

* * * * *